US006196255B1

(12) United States Patent
Poillucci

(10) Patent No.: US 6,196,255 B1
(45) Date of Patent: Mar. 6, 2001

(54) MANIFOLD/DISTRIBUTOR ASSEMBLY FOR COMBUSTIBLE GAS SUPPLIED FROM A PLURALITY OF LIQUEFIED-GAS CARTRIDGES

(75) Inventor: Giovanni Poillucci, Osimo (IT)

(73) Assignee: Walter Tosto Serbatoi S.p.A., Pescara (IT)

( * ) Notice: Subject to any disclaimer, the term of this patent is extended or adjusted under 35 U.S.C. 154(b) by 0 days.

(21) Appl. No.: 09/180,248

(22) PCT Filed: Apr. 18, 1997

(86) PCT No.: PCT/EP97/01947

§ 371 Date: Mar. 22, 1999

§ 102(e) Date: Mar. 22, 1999

(87) PCT Pub. No.: WO97/42446

PCT Pub. Date: Nov. 13, 1997

(30) Foreign Application Priority Data

May 3, 1996 (EP) ..... 96830258

(51) Int. Cl.[7] ..... F17C 1/00; F17C 13/08; F24C 3/14

(52) U.S. Cl. ..... 137/266; 137/255; 137/259; 222/145.1; 222/6

(58) Field of Search ..... 137/255, 256, 137/257, 259, 266; 222/145.1, 145.7, 3, 6

(56) References Cited

U.S. PATENT DOCUMENTS 3,161,322 12/1964 Stone .
3,930,598 * 1/1976 Slagle ..... 137/266 X
4,460,010 * 7/1984 Paravigna et al. ..... 137/266 X
4,461,271 7/1984 Juang .

FOREIGN PATENT DOCUMENTS 19619779 11/1996 (DE) .
0155407 9/1985 (EP) .
1503773 12/1967 (FR) .
2076256 10/1971 (FR) .
2642142 7/1990 (FR) .
2262156 6/1993 (GB) .

* cited by examiner

*Primary Examiner*—Kevin Lee
(74) *Attorney, Agent, or Firm*—Cowan, Liebowitz & Latman, P.C.; William H. Dippert

(57) ABSTRACT

Manifold/distributor assembly for combustible gas supplied from a plurality of liquefied gas cartridges, comprising a frame (1) with upper and lower covers (64, 65) forming a leaktight box (95) and, within the box, a plurality of housings (2), each for housing a liquefied gas cartridge (36, 85) and each one being provided with a valve assembly (71) incorporating an actuation element (13, 91), which valve assembly does not open unless a cartridge is present in the housing and actuates the element; the outlet of each valve assembly being connected to a manifold (15, 16, 17, 18, 73, 74, 75, 76, 77, 78, 79) comprising a multiple-way tap (80) for selective connection of manifold portions to a delivery pipe (22), in case through a pressure regulator (81).

10 Claims, 9 Drawing Sheets

MANIFOLD/DISTRIBUTOR ASSEMBLY FOR COMBUSTIBLE GAS SUPPLIED FROM A PLURALITY OF LIQUEFIED-GAS CARTRIDGES

FIELD OF THE INVENTION

The present invention relates to a manifold/distributor assembly for combustible gas supplied from a plurality of liquefied-gas cartridges.

BACKGROUND OF THE INVENTION

It is known that liquefied gas for domestic use, in particular for supply to cookers and possibly heating appliances, is distributed to the users by means of refillable pressurized cylinders, which have considerable weight and bulk, from service centres which also effect the collection of the exhausted cylinders and the refilling thereof.

The costs of delivery have a significant effect on the service, the timing of which is generally difficult to match to requirements, which can therefore be met only by providing, on the premises of the user, a reserve cylinder to replace the exhausted cylinder as soon as the need therefor arises.

The domestic storage of the reserve cylinder and the installation thereof for use, which installation is carried out by generally inexpert persons, constitute a non-negligible risk factor, which is aggravated by the difficulty of having to handle an object which is bulky and of considerable weight.

It is also known that in order to ensure greater safety, improved portability and convenience of use, the liquefied gas may be supplied in single-use sealed cartridges (or even cartridges having a closing, non refill valve) of restricted dimensions and limited capacity, of the order of one liter or less, which, when exhausted, are discarded.

By virtue of the ease of handling of these cartridges and of the reduced bulk of the appliances which make use of them, these cartridges find widespread use for camping and for supplying portable appliances in which the limited independence and heating power which can be provided by the cartridges do not constitute a problem, as is, however, the case in domestic use, where it is obligatory to employ refillable cylinders of greater capacity, with the disadvantages which have already been indicated.

It has been proposed, to overcome the limited autonomy of the cartridges, to provide a manifold set which houses a valve-type-cartilage battery and which can be operated to control the joint opening of the valve of all the cartridges installed in the set, thus connecting them jointly to a delivery pipe.

An example in this direction is provided by the document FR-A-2.642.142.

The proposed solution does not ensure the service continuity and from the user standpoint does not provide adequate safety.

In fact, if due to inadvertency, even a single one of the cartridges which must be installed in the manifold set is not installed, or is improperly set, very dangerous gas leakage can occurr.

In addition replacement of the exausted cartridges can only be performed collectively and requires the manifold set to be put out of service.

Further the use of a number of cartridges lesser than the number of cartridges to be installed is impossible and therefore it is not possible to tailor the equipment to different user needs.

Similar limitations are present in U.S. Pat. No. 3,161,322 which discloses a pocket gas dispenser where a plurality of micro cartidges can be selectively connected to a manifold, through a compressible pad operating as a shut-off valve when compressed.

Depending on the compression degree imposed by axial movement of the cartridge against the pad, a cartridge can be punctured by a pin, the pad then intercepting communication of the cartridge with the manifold, then, moving the cartridge away from the pin, the pad compression is released and the communication is established.

Although collective connection of several cartridges to the manifold or selective exclusion therefrom can be provided, it is not possible to perform a selective replacement of the cartridges, by the more with the dispenser in use, nor to load the dispenser with a number of cartridges lesser than the one for which it is designed, because that would involve gas leakage.

Control of the connection opening or shut-off requires further a displacement of the cartridges, easily achievable with micro cartridges only.

FR-A-2.076.256 discloses a cabinet and gas cylinders contained therein; the gas cylinders are connected to a common manifold, each cylinder through a respective pressure reducer and a respective shut-off tap.

The present invention aims to provide a manifold/distributor for combustible gas supplied from a plurality of liquefied-gas cartridges, which manifold/distributor is capable of performing as well as a refillable cylinder while in addition giving continuity of service, safety of use and ease of replacement of the cartridges, when exhausted, the supplying of which is particularly convenient, and can be carried out directly by the user, without the need to have recourse to a service centre.

These results are achieved, according to the present invention, by a manifold/distributor assembly comprising a frame forming a plurality of cartridge housings, at least partial housings, and a manifold provided with a plurality of valve assemblies each incorporating an actuation element for opening the cartridges, one for each cartridge housing, which valve assemblies are normally closed and are only opened when a cartridge is present in the respective housing, characterized by comprising a multiple-way tap, which puts a delivery conduit in fluid communication with the whole manifold, with portions thereof or with none of them.

The manifold/distributor can be provided with a pressure-reducing regulator, which is conventional per se, with outlet adapter for connection to a consumer appliance,. for example a domestic cooker.

The cartridges are preferably of the valve-type with screwed boss for cartridge mounting, of the standard type defined for instance by European Regulation EN 417, but with a modified bottom which enables their manual holding and their screwing even in case a plurality of cartridges is tightly juxtaposed.

Preferably the valve assemblies provide a double closing protection and consist in a shut-off valve, opened only in presence of a cartridge, coupled to the cartridge shut-off valve, and in a non return valve, cascade connected.

According to a further aspect of the present invention, the frame forms a container for the manifold and the cartridges which can be tightly closed for transportation or storing in very safe conditions.

Advantageosly the tight container can be provided, for further safety, with a pressure detection device for detecting internal overpressure of the container resulting from gas leakage and for signalling the event.

A vent pipe may also be provided to put the container in communication with the external ambient, so as to prevent local and indoor formation of inflammable gas mixture in case of gas leakage.

BRIEF DESCRIPTION OF THE DRAWINGS

The features and the advantages of the invention will become clearer below with reference, to the accompanying drawings, in which.

DETAILED DESCRIPTION OF THE INVENTION

Figure 1:
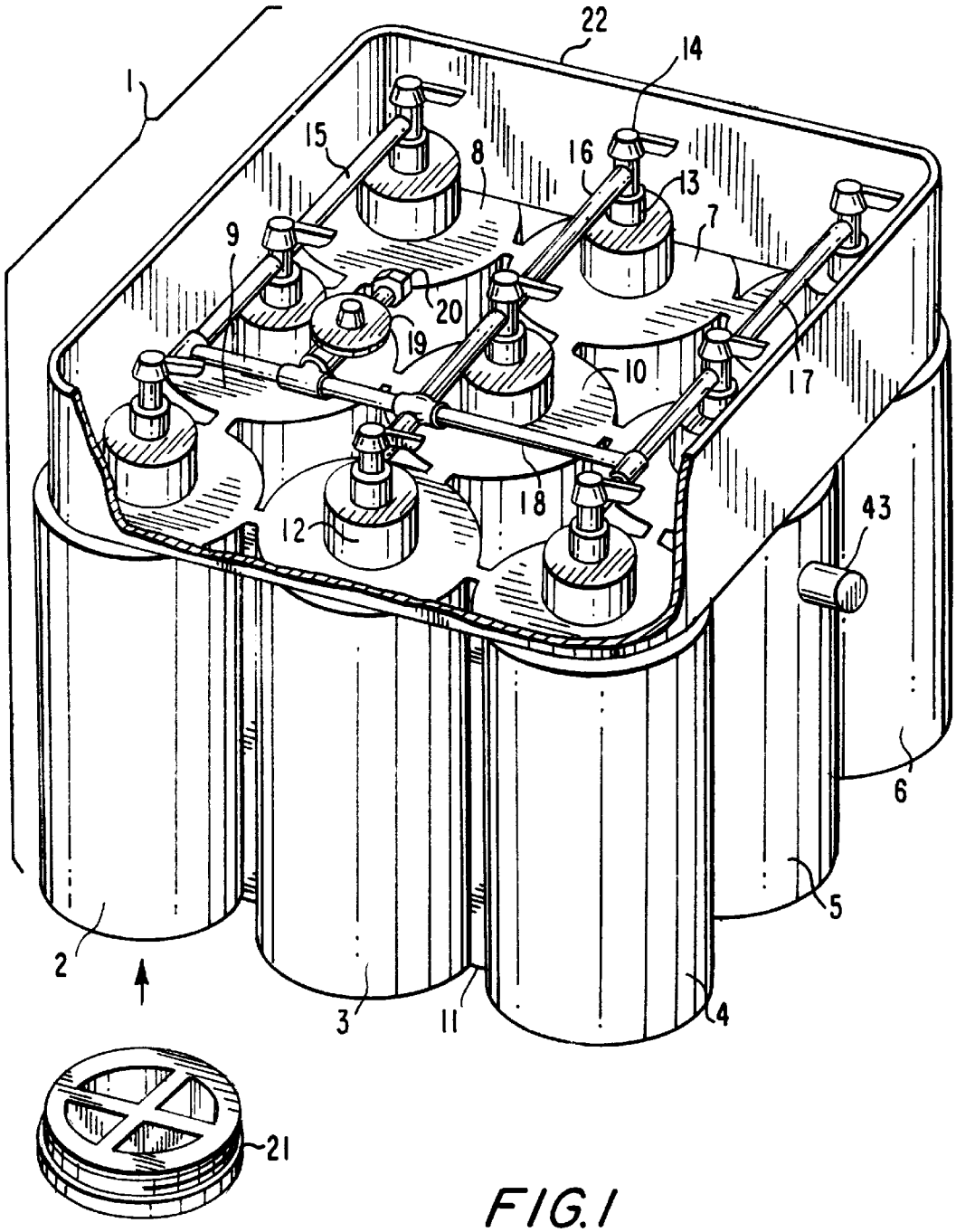
FIG. 1 is an overall perspective view of a manifold/distributor assembly.

With reference to FIG. 1, a manifold/ distributor assembly consists essentially of a frame 1, preferably obtained by moulding a plastic material and forming a plurality of cylindrical containers or housings 2,3,4,5,6,7,8,9,10, which are disposed parallel to one another, juxtaposed in a plurality of rows, and integral with one another, in the present case by means of connecting ribs such as 11.

At the upper end, the housings are each provided with a neck 12, on which there is fixed a valve assembly 13, incorporating a puncturing needle, the outlet of which is connected to a shut-off tap such as 14, with manual actuation by lever or knob.

The outlets of the various taps are connected to one another by means of pipes 15, 16, 17, 18 which meet in a pressure reducer/regulator 19, which is conventional per se, with outlet adapter 20 for connection to a consumer appliance and which, in conjunction with the valve assemblies and with the taps, constitute a distributing manifold with selective control of a plurality of sources of combustible gas, each being in the form of a liquefied-gas cartridge which is housed in one of the containers.

The insertion of the cartridges in the various containers is effected via the open lower end of the containers, into which there is screwed a closure base or alternatively just a radially configured ring 21 for clamping and retaining the cartridge.

As the clamping ring is screwed up, the cartridge, which may be of known or commercially available type, is pressed against the valve assembly incorporating the puncturing needle which is disposed in the neck of the container and is punctured.

There is thus established, via the puncturing needle, a communication between the interior of the cartridge and the distributor manifold which permits the extraction of the gas from the cartridge and the distribution thereof via the manifold.

Preferably but not necessarily, the frame 1 forms not only the various cylindrical containers but also a surround 22, which is extended to rise above the various containers and which houses and protects the manifold, the shut-off taps and the reducer/regulator.

To facilitate the operations of replacement of the cartridges, the frame is, preferably but not necessarily, provided with two aligned support pivots, one of which, 23, can be seen in FIG. 1, to permit the installation thereof in a housing with the possibility of rotation, even if only partial, on the pivots.

Figure 2:
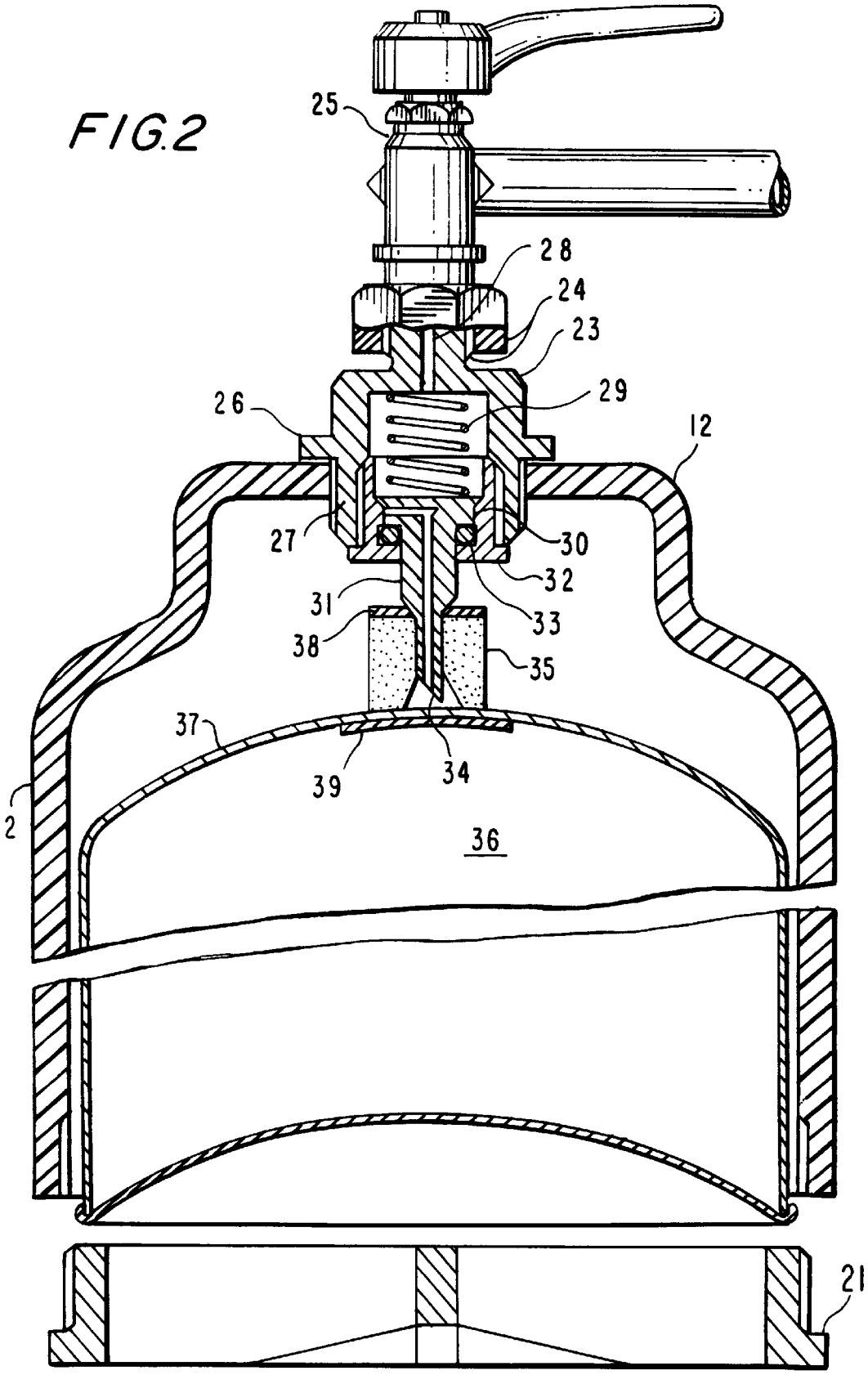
FIG. 2 is a view, in diametral section, of a valve assembly incorporating a puncturing needle for the manifold/distributor assembly of FIG. 1.
Figure 4:
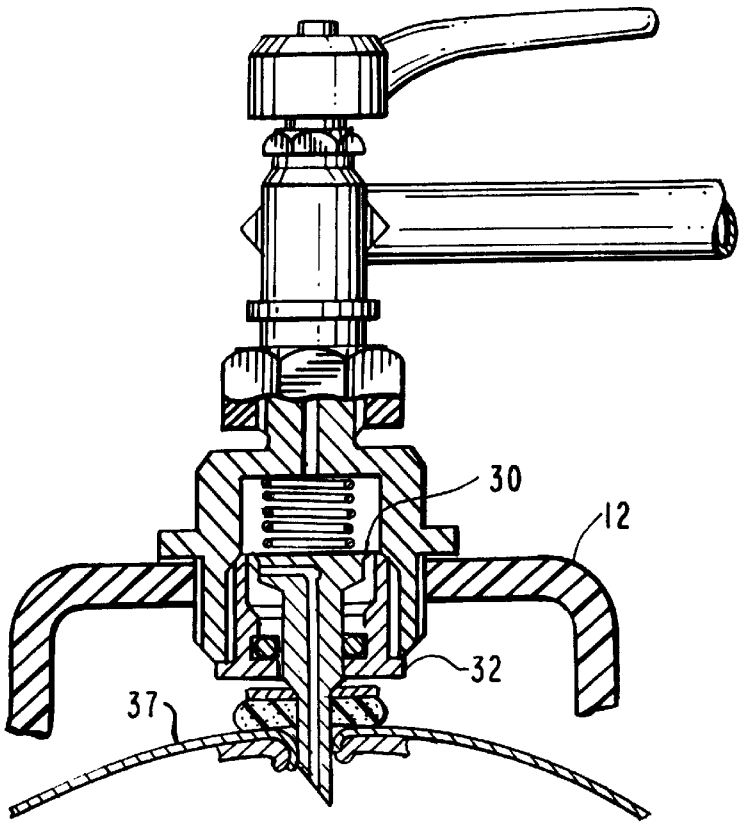
FIG. 4 is a view, in diametral section, of the valve assembly of FIG. 2 with the cartridge installed and the valve assembly open.

FIG. 2 represents, in diametral cross-section, one of the cylindrical containers and the associated valve assembly incorporating a puncturing needle to show the structure and the operation thereof.

The valve assembly consists of a body 23 which is essentially cylindrical and is provided, at one end, with a threaded extension 24 for connection to a shutoff tap 25 and, in an intermediate position, with a prismatic clamping flange 26.

That portion 29 of the body 23 which is on the opposite side from the extension 24 in relation to the flange 26 is threaded to allow it to be screwed forcibly into an aperture formed in the upper neck 12 of the container 2.

Although not essential and not shown, there may also be provided a clamping locking nut, to be screwed onto the body portion 27, with interposition of the neck 12 between flange 26 and locking nut.

In the body 23 there is formed a cylindrical housing, communicating with the tap 25 via an aperture 28 formed in the extension 24, which housing is open at the opposite end from the extension. 10 Within the housing there are housed a compression spring 29 and a disc obturator 30 which is extended to form a puncturing needle 31 and retained within the housing by a threaded bushing 32 screwed into the body 23, through which bushing there passes the axially slidable puncturing needle 31.

A resilient ring (o-ring) 33, interposed between needle 31 and bushing 32, ensures the leaktightness of the slidable coupling between needle and bushing.

The needle 31 ends in a puncturing tip 34.

An internal through hole places the tip 34 of the needle in communication with the peripheral surface of the disc 30 which, preferably but not necessarily, is suitably conical for coupling, in sealed fashion, with a similarly conical seating of the bushing 32.

The disc is retained against the conical seating, formed in the bushing 32, by the thrust exerted by the compression spring.

On the needle 31 there is mounted a resilient pad 35 which embraces the puncturing tip 34 and is supported by a rigid disc 38 which is fixed to the needle.

FIG. 2 also shows a liquid gas cartridge 36, of conventional type, which is housed in the container 2.

The cartridge 36 is shown in a position of partial insertion into the container 2, with the top dome 37 in contact with the pad 35.

Upon partial screwing-up of the clamping ring base 21 into the open end of the container 2, the cartridge is gradually pressed against the puncturing tip 34 and punctured.

Figure 3:
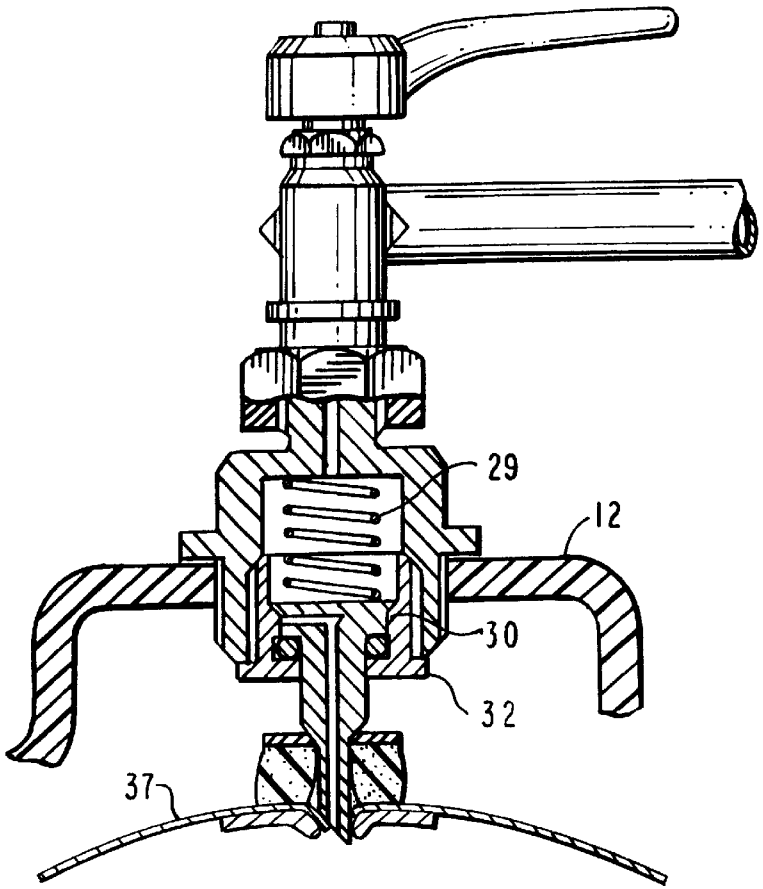
FIG. 3 is a view, in diametral section, of the valve assembly of FIG. 2 in a phase of cartridge installation during which the puncturing needle is inserted into the cartridge, but the valve assembly is closed.

This condition is shown in FIG. 3.

It should be noted that in this phase the spring 29 opposes the possible displacement of the disc 30, so that the valve formed by the disc and by the bushing 32 remains closed.

The escape of gas from the perforated cartridge to the interior of the container 2 is prevented by the seal formed by the resilient pad 35 squeezed between supporting disc 38 and dome 37.

Upon further screwing-up of the clamping base or ring 21, the cartridge is pressed further towards the neck 12 and acts, via the pad 35 which is compressed to the maximum extent, on the supporting disc 38, thereby pressing the needle up into the disc housing. In addition, as it overcomes the reaction exerted by the spring 29, it forces the disc 30 to move away from its seating, causing the valve to open.

In this condition, if the tap 25 is open, the gas which escapes from the cartridge 36 can be distributed via the manifold.

Normally, inside cartridges such as 36, there is fixed to the dome 37 on the underside of the puncturing zone, an adhesive resilient patch 39 which has the function of retaining any chips that may be produced by the puncturing operation.

This patch, which is conveniently thickened, can operate as a resilient bung which, by reason of its elasticity, tends, when the cartridge is removed from the housing, to reclose, even though not hermetically, the aperture produced by the puncturing needle, thus reducing the escape of any residual gas contained in the cartridge which, under normal conditions of use, upon exhaustion of the cartridge, comes to be at a pressure approximately equal to or slightly greater than ambient pressure, for which reason the escape is very small and the total volume of gas which flows out is thus diluted in the atmospheric air so as not to constitute a risk factor.

To remove the cartridge, it is sufficient to unscrew the clamping base/ring 21.

In a first phase of unscrewing, the disc valve is closed automatically by the thrust exerted by the spring 29, preventing a flow of gas from the tap 25 to the needle, even if the tap 25 is inadvertently left open.

A dual safety protection is thus provided.

In a subsequent phase, the thrust exerted by the resilient pad 35 causes an at least partial removal of the puncturing tip 34 from the cartridge which, when the unscrewing of the base 21 has been completed can easily be removed from the container 2.

Figure 5:
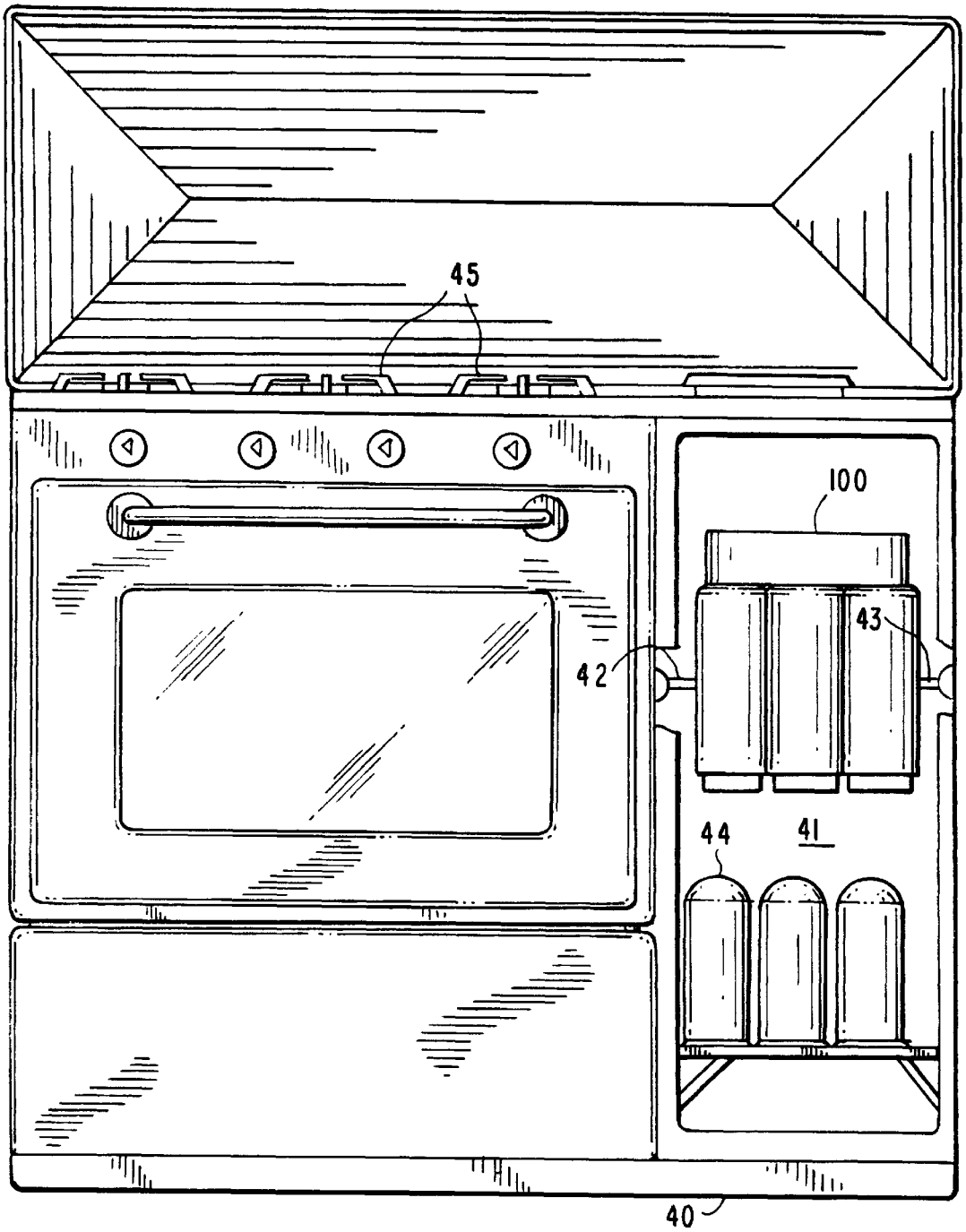
FIG. 5 is a front view of a domestic cooking appliance using the distributor assembly of FIG. 1.
Figure 6:
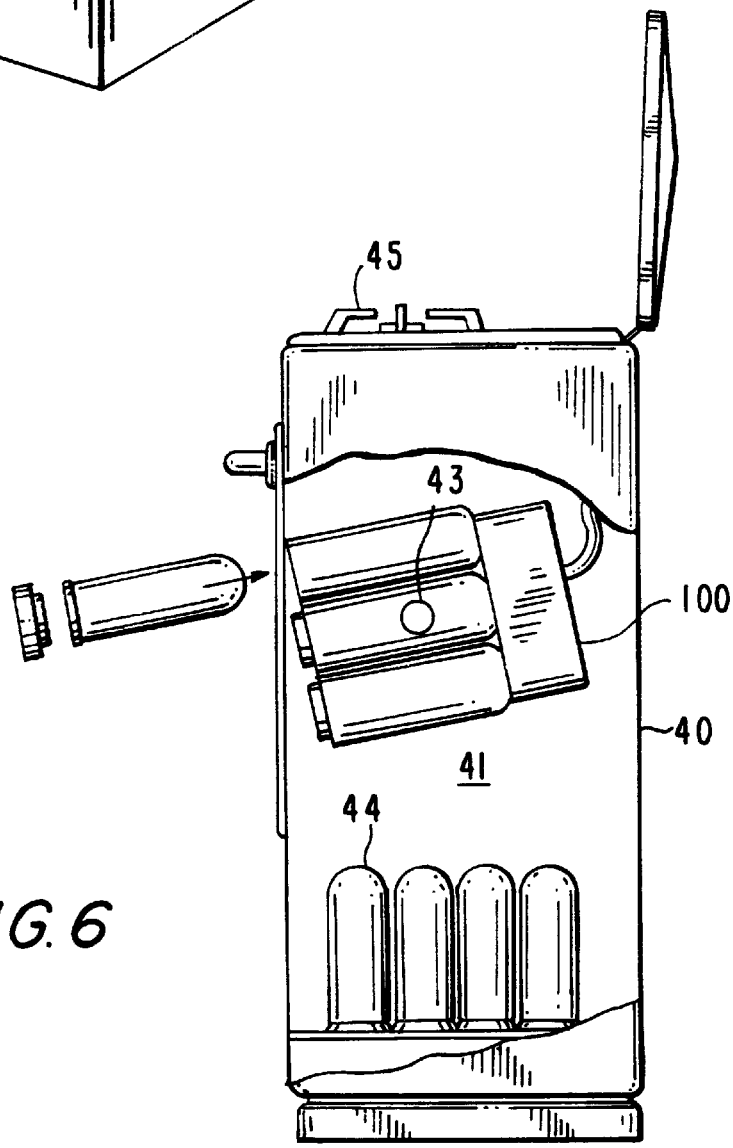
FIG. 6 is a lateral view, partly in cross-section, of the appliance of FIG. 5.

FIGS. 5 and 6 represent, in front view and side view respectively, a preferred application of the described manifold/distributor assembly, in a cooker 40 of known type, which cooker is intended to be supplied by a liquefied-gas cylinder.

Cookers of this type have a lateral space 41, closed by a door, to house a pressurized liquid gas cylinder.

By way of replacement for the cylinder, there may easily be installed a distributor/manifold assembly 100, of the type described, with a useful capacity of 9 dm (corresponding to the capacity of 9 cartridges of commercially available type).

Conveniently, the assembly 100 is pivotally mounted on the pivots 42, 43 in a high position within the space 41, in order to be able to rotate, as shown in FIG. 6, and thus to permit an easy insertion and replacement of the cartridges in the housings of the assembly.

In the lower part of the space 41, extensive room is available for the storage (in complete safety) either of exhausted cartridges or of replacement cartridges 44.

The assembly 100 is connected to the rings 45 and to the oven burner, via a conventional flexible tube.

For the operation of the cooker, it is sufficient, once a certain number of cartridges have been installed in the assembly 1, preferably but not necessarily in all the available containers, to open the taps associated with a certain number of cartridges, preferably not all of them.

In this way, a certain number of reserve cartridges, ready for use, are present and installed in the assembly 100.

As soon as the flow distributed from the active cartridges is exhausted, with the consequent extinction or weakening of the flame, the exhausted cartridges can be disconnected from the manifold by closing the respective taps and the reserve cartridges can be connected to the manifold by opening the respective taps, with a rapid restoration of the supply.

If this is considered necessary on account of cooking or other requirements, it is also possible to activate reserve cartridges without the prior disconnection of the exhausted cartridges, deferring their replacement to a later time.

The aforegoing description relates only to a specific manifold/distributor assembly, but it is clear that many variants may be made, including in relation to the possible introduction onto the market of cartridges of larger size and larger capacity, which is essentially limited by specific regulations, solely for reasons of safety.

Thus, the assembly which has been described may provide, rather than nine cylindrical containers arranged in three rows of three containers each, a larger or smaller number of containers.

Rather than being internally screwed to the containers, the closure bases of the various containers may be externally screwed.

Figure 7:
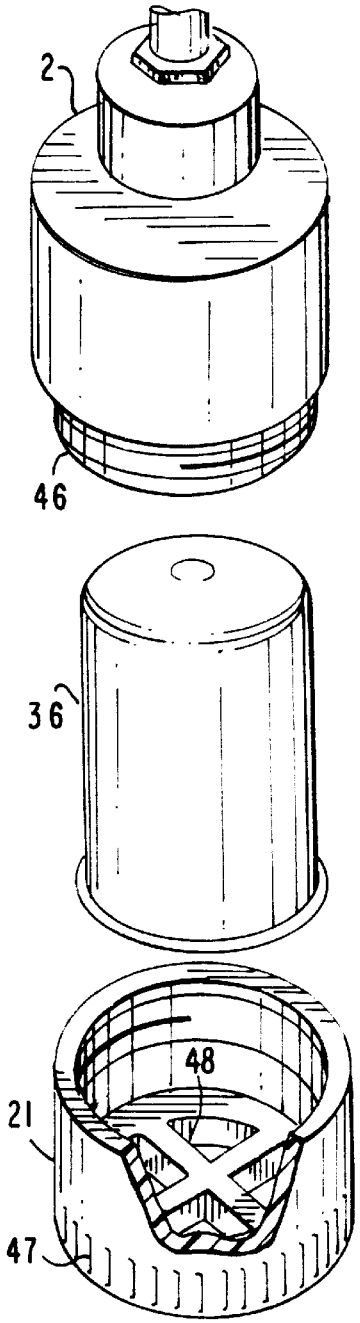
FIG. 7 is an exploded perspective view of a first modification of a cartridge container and the associated base for the assembly of FIG. 1.

FIG. 7 is an exploded perspective view of this possible solution, and shows a container 2 provided with an external thread 46 on its open end.

In the container 2 there is housed, fully or alternatively only partially, as shown, a cartridge 36 which is retained in the container by a base 21 which is screwed onto the thread 46.

As shown, the base may partially house the cartridge 36, so as to facilitate the removal of the cartridge when the base is unscrewed and removed.

For the convenient screwing of the base, the latter may be provided with an external milling 47 and/or with external lower fins 48.

Clearly, the thread 46 is only illustrative and can be replaced by a bayonet coupling system.

It is also conceivable that, in relation to the specific application, cartridges might be produced which are provided on the external cylindrical surface with projections for screw coupling or bayonet engagement in the cylindrical containers of the assembly 1, which containers are, for this purpose, provided with appropriate internal grooving or threading.

Figure 8:
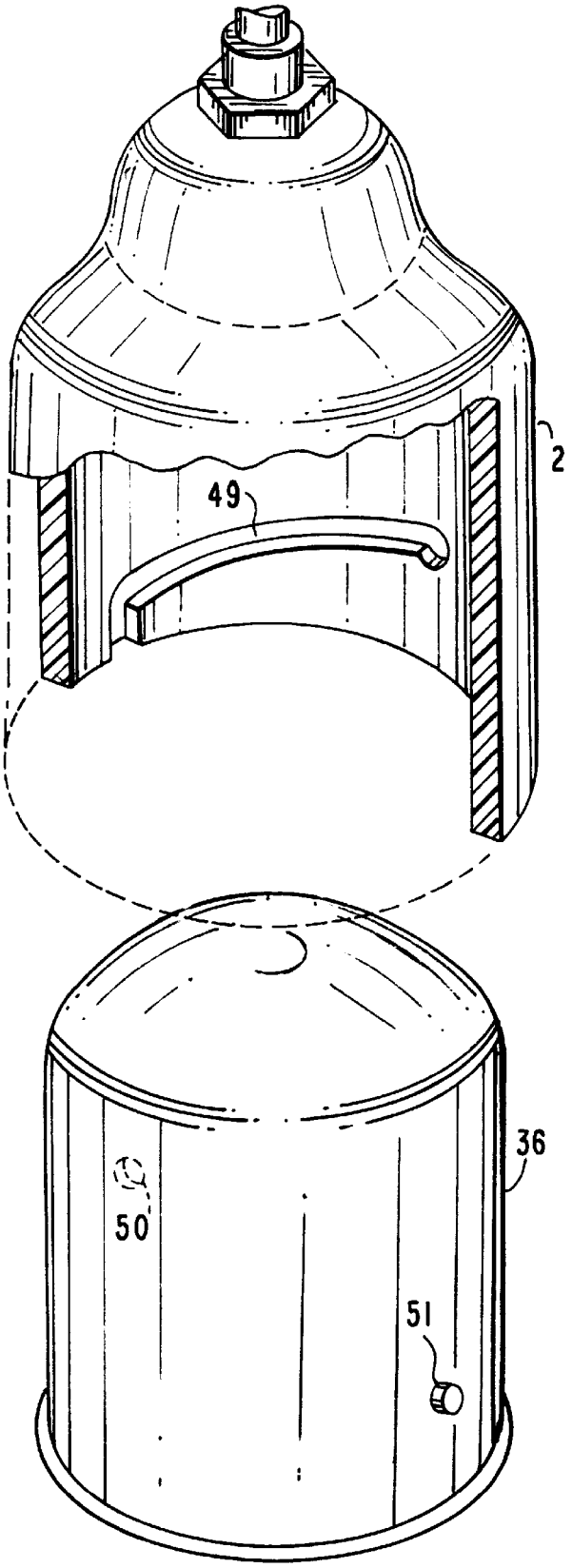
FIG. 8 is an exploded perspective view of a second modified embodiment of a cartridge container for the assembly of FIG. 1.

FIG. 8 shows, in a perspective view, partly in cross-section, this possible construction and shows a container 2 provided, on its internal cylindrical surface, with a pair of helical grooves which are radially opposite and one of which, 49, can be seen and into which there are inserted two projections 50, 51, which are radially opposite and which are formed on the external cylindrical surface of the cartridge 36.

The grooves such as 49 form a bayonet engagement for the cartridge 36.

It is clear that the grooves such as 49 may also constitute a continuous thread with two or more starts, for screw engagement of the cartridge, the latter also being provided with discontinuous projections or protuberances, or with a continuous threading.

It is, however, preferable that the cartridge should be provided with discontinuous projections or protuberances and not with a continuous thread, in order to avoid possible deformations due to the internal pressure of the cartridge which, otherwise, if the casing is not sufficiently rigid, might behave to some extent as a resilient bellows.

Furthermore, whilst the puncturing operation is obtained, in the aforegoing description, by an axial movement of the cartridge in the container brought about by the screwing of a base (or by the rotation of the cartridge), it is also possible to obtain the same effect, with the cartridge stationary in its housing, by a relative movement of the puncturing needle brought about by a tap, which is actuated manually and which first of all executes the puncturing and only subsequently opens, bringing the interior of the cartridge into communication with the distributor manifold.

Figure 9:
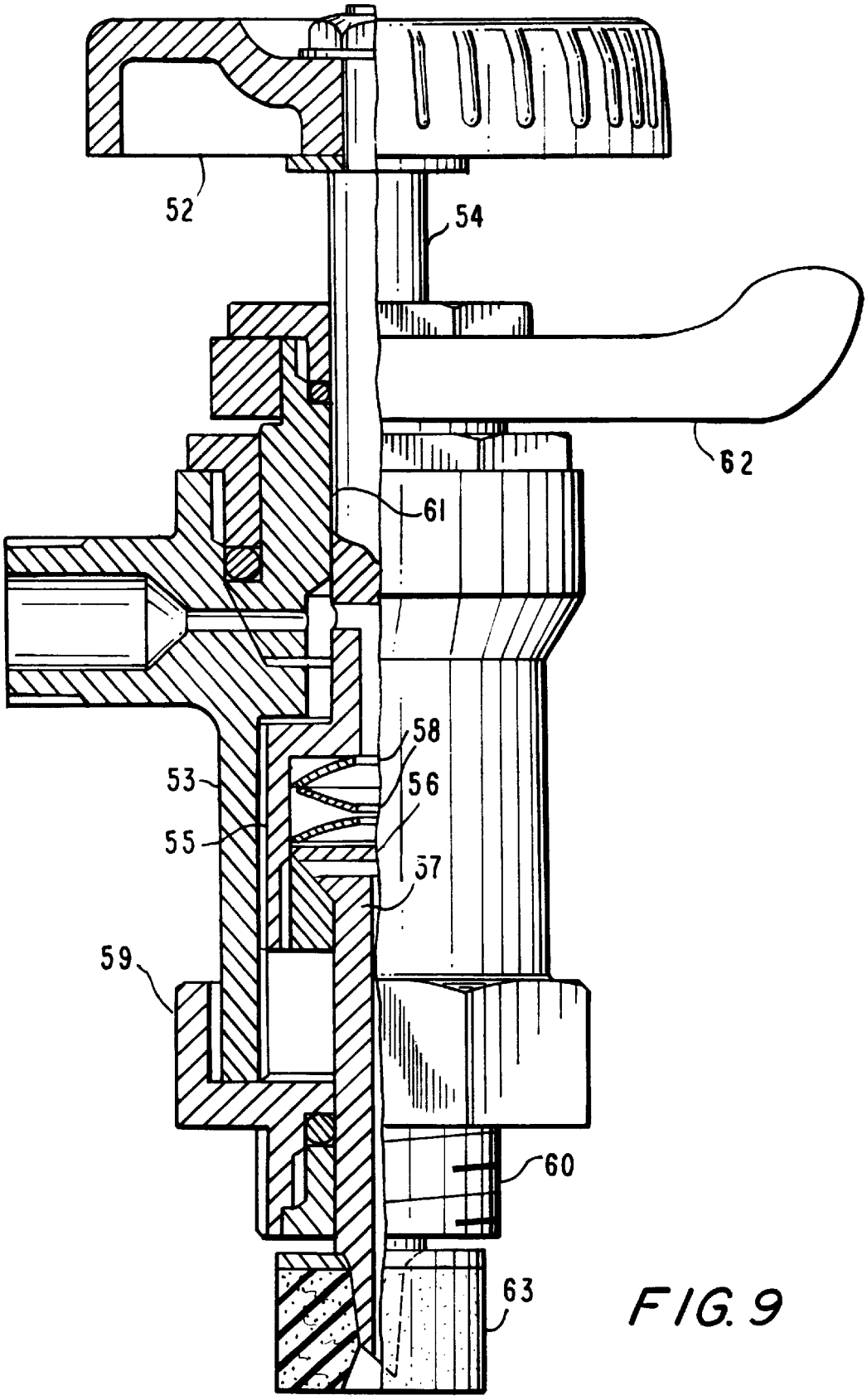
FIG. 9 is a view, partly in diametral cross-section, of a modification of a valve assembly incorporating a puncturing needle and shut-off tap for the assembly of FIG. 1.

FIG. 9 represents, by way of example, a valve assembly with puncturing needle and shut-off tap which are integrated into a single associated unit, with actuation from the top, which is thus completely independent of the axial displacements of a cartridge in its housing.

In this case, the cartridge may also be fixed in its housing by conventional hook systems.

A puncturing knob 52 permits the screwing into a valve body 53, by means of a stem 54, of a screw sleeve 55 in which there is housed a valve disc 56, which is extended to form a puncturing needle 57.

The disc is retained in its closed position by diaphragm springs 58 or equivalent means.

The seating of the screw sleeve 55 is closed by a stopper 59, which is screwed onto the body 53 and is in its turn provided with a screw extension 60 for fastening to the neck of a cartridge housing, which is not illustrated.

The puncturing needle 57 is able to slide axially through the stopper 59.

In the body 53 there is also formed a seating for a rotating obturator 61 for the shut-off tap. The latter may be cylindrical, flat or preferably frustoconical, as illustrated, and is actuated by a lever 62 from closed positions to a predetermined open position.

Passing freely through the rotating obturator 61 is the stem 54, which is free to slide axially and to rotate.

Suitable seals positioned by nipples in a conventional manner ensure leaktightness between parts which are movable relative to one another.

In the position illustrated, the puncturing needle is in a retracted position, with the end of the stroke determined by contact between body 53 and sleeve 55.

The rotary actuation of the knob 52 causes the sleeve 55 to be screwed into the body 53, with rotary and axial sliding movement, in a downward direction, of the knob 52, of the stem 54 and of the sleeve 55.

There is thus a visual indication of the axial displacement of the puncturing needle 57 which, via the cup springs 58, is pressed towards a cartridge (not illustrated) and punctures it.

The resilient pad 63 ensures leaktightness between needle 57 and cartridge and, once compressed to the maximum extent by interaction with the cartridge, causes the disc valve 56 to open.

In the absence of a cartridge, the disc valve 56 remains closed, guaranteeing maximum safety even in the case where the shut-off tap, formed by the obturator 61 is open.

This solution also lends itself to significant variants.

By way of example, the screwing of the stem 54 may be obtained by a thread on said stem and the sleeve 55 may be uncoupled, both axially and in rotation, from the stem 54 and biased into the position indicated in FIG. 9 by a spring compressed between sleeve 55 and stopper 59.

In this case, the stem 54, which is necessarily provided with an abutment to limit unscrewing, may act on the sleeve 55 as a simple axial-thrust ferrule.

It should be noted that, whilst the dual-safety system using a shut-off tap and an independent valve, which is open only in the presence of a cartridge, is preferable and essential in order to permit the selective disconnection of reserve cartridges installed in the manifold/distributor assembly, it is also possible, if these functional capabilities are not required, to adopt simpler solutions in which only the safety valve associated with the puncturing needle is present.

Figure 10:
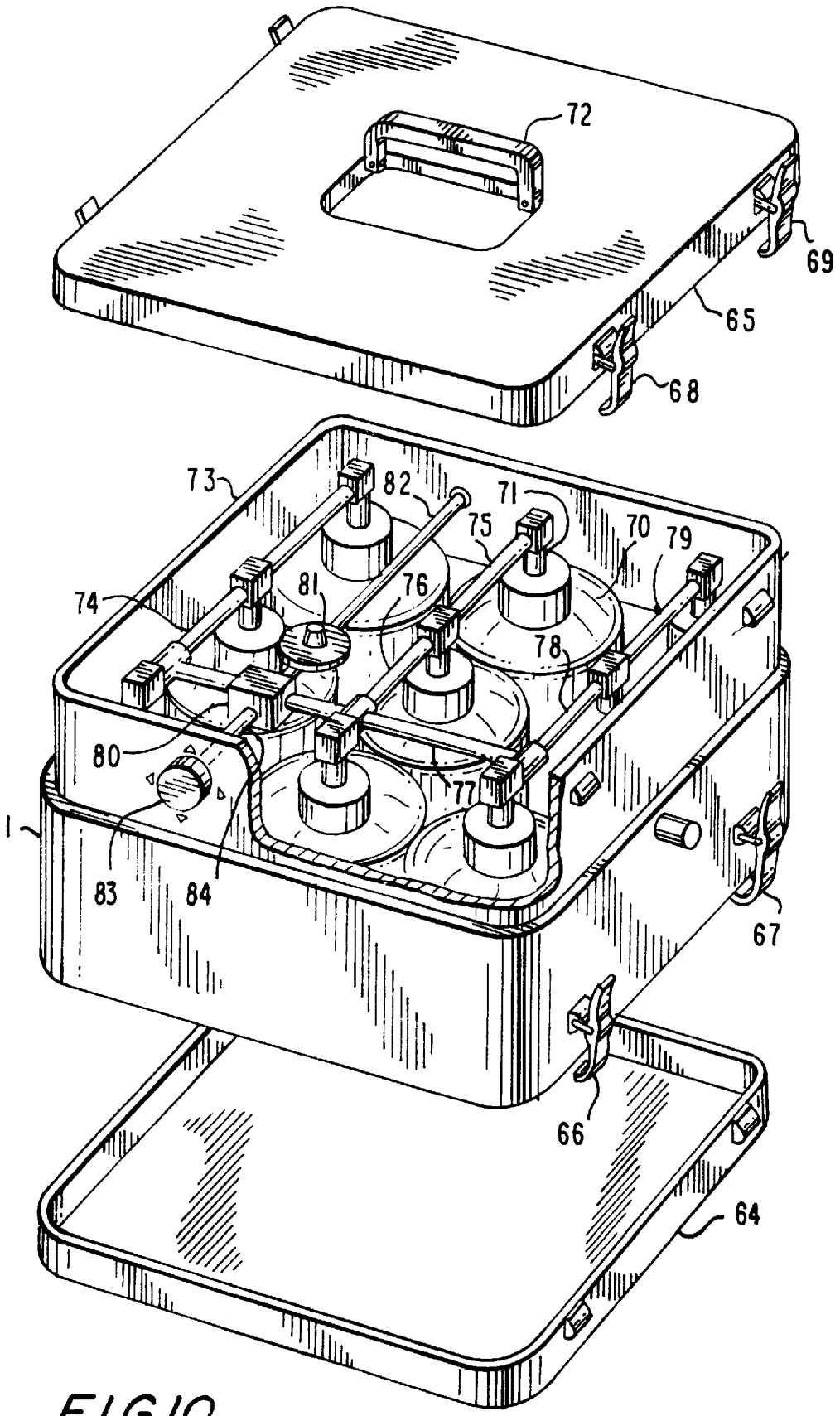
FIG. 10 is a perspective, exploded view of an embodiment of a manifold/distributor assembly in accordance with the present invention, where the assembly forms in particular a tight, gas-leakage-proof container.

FIG. 10 shows, in perspective, exploded view an embodiment which does not give-off the above functional capabilities, provides some simplification, the maximum achievable compactness and further enhances the safety of the equipment.

In FIG. 10 the manifold/distributor assembly comprises a frame 1 forming a substantially rectangular box with bottom and top faces closed bu removable upper and lower covers 64 and 65 respectively.

The upper and lower covers are tightly coupled to the box by suitable gaskets (preferably O-Rings) not shown, and by retaining hooks, such as 66,67,68,69, manually operated for their hooking or release.

The upper cover is expediently provided with a handle 72.

The frame 1 forms a plurality of internal emispherical caps, such as 70, each for housing and guiding the head of a cartridge to an actuation valve assembly, such as 71, similar to those already described with reference to FIGS. 2 and 9 and discussed more in detail in the following.

The output of the several valve assemblies, which preferably comprise also a non-return valve, are coupled together by two sets of connection pipes 73,74 and 75,76, 77,78,79 respectively which form two portions of a manifold.

The two sets are in turn copled to a multiple-way manually operated tap (a four way tap in particular) which establishes a selective fluid connection among them and a pressure/reducer regulator 81, whose output is in turn coupled to a delivery pipe 82.

The delivery pipe 82 preferably opens outside the box through a tight seal passage in the frame 1.

An external actuation knob 83, having (in the example) four angular positions, actuates the multiple-way tap through a shaft 84 passing through a tight seal passage in the frame 1.

In particular, when the knob is in a first position the tap is closed and no fluid connection is established between the manifold and the pressure regulator.

When the knob is in a second position a fluid connection is established between the whole manifold and the pressure regulator.

When the knob is in a third position, a fluid connection is established between the manifold portion formed by pipes 73,74 and the pressure regulator.

When the knob is in a fourth position, a fluid connection is established between the manifold portion formed by pipes 75,76,77,78,79 and the pressure regulator.

As a possible alternative, the fluid connection may be established wit the delivery pipe 82 and the pressure regulator 81 may be a device external to the box and not an integral part of the equipment.

Figure 11:
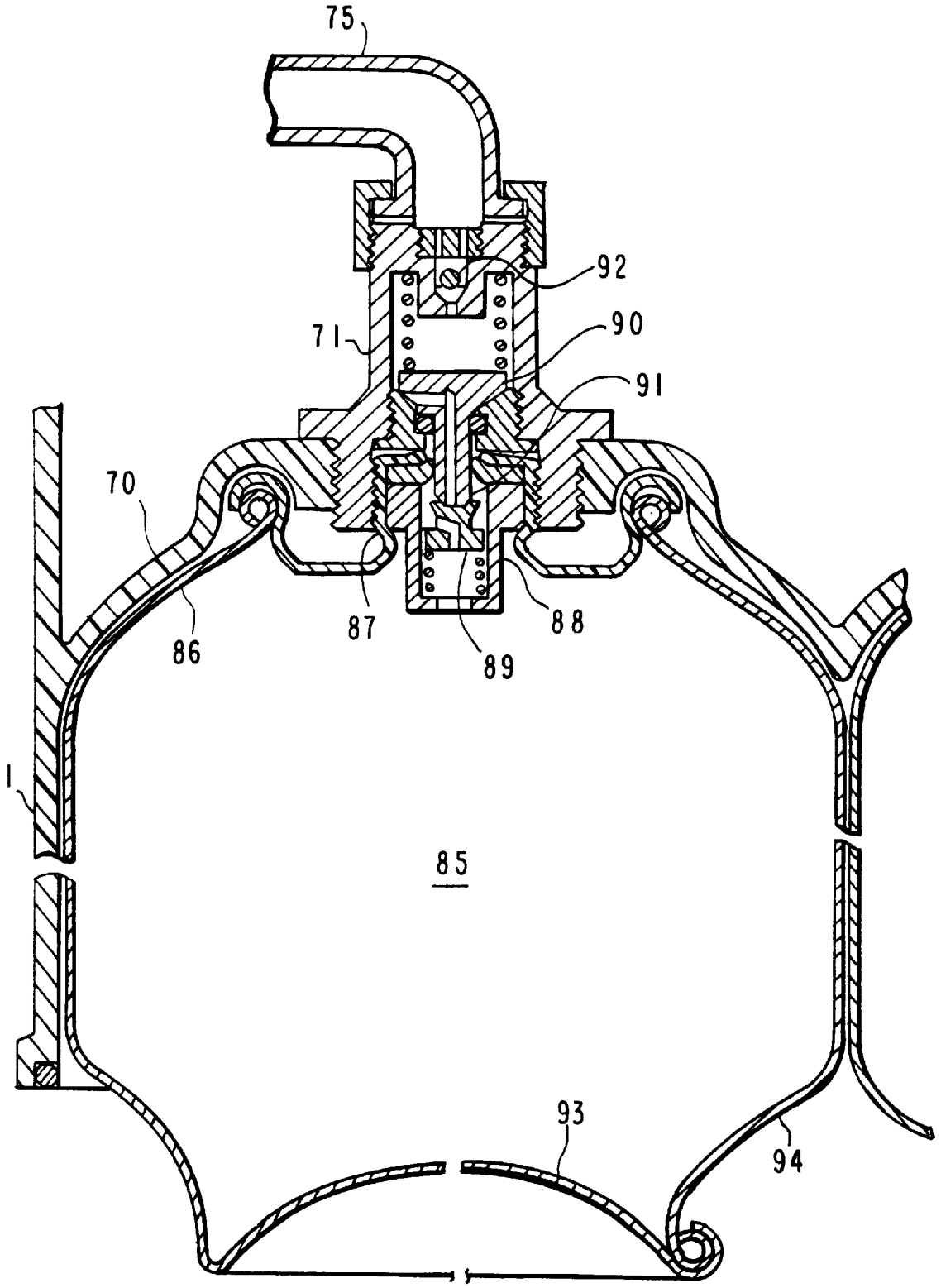
FIG. 11 is a section view in diametral section of a valve assembly for the embodiment of FIG. 10, intended for coupling with a valve-type cartridge.

FIG. 11 is a diametrical section of one of the valve assemblies such as 71, of one of the caps, such as 70, and of a cartridge 85 coupled to the valve assembly 71.

In the embodiment shown the cartridge is of the valve-type.

The generally emispherical top 86 of the cartridge is housed in the cap 70, which serves as a guide for precisely aligning and orienting a screwed boss 87 of the top, relative to a screwed input recess of the valve assembly.

Inside the boss 87 there is provided a conventional shut-off valve 88, which may be opened by pushing inside the valve plug 89 with an actuation element which may be a pin, needle or plate of the valve assembly 71, depending on the design of the plug 89, which itself may be provided with a needle like actuator extending out of the boss.

The valve assembly is very similar to the one already shown in FIG. 2 and comprises a spring biased, normally closed disc obturator 90 extending in an actuation needle 91.

When the cartridge boss is screwed in the recess of the valve assembly 71, the cartridge valve is opened and when fully opened the force exerted by the plug 89 on the needle 91 overcomes the bias applied to the disc obturator, which opens and establishes a fluid connection between the cartridge and the manifold.

The gasket inherent in the cartridge valve, which also interacts with the actuation needle 91, prevents any gas leakage but, if desired, for enhanced safety, an additional resilient gasket may be provided between the boss head and the bottom of the screwed input recess of the valve assembly.

In case, an arrangement similar to the pad 35 and rigid disc 38 coupled to the needle, as shown in FIG. 2, may be provided.

Cascaded to the disc obturator 90, the valve assembly 71 provides for a non-return valve, of conventional structure, and consisting for instance in a floating ball 92, biased against a seat of the valve assembly by an overpressure at the valve assembly output relative to the input and driven away from the seat by a pressure at the input slightly exceeding the one at the output.

By this arrangement a double protection is ensured which prevents any gas leakage from the manifold towards the valve assembly input even in case the cartridge is missing or improperly set and the actuation valve is clogged, for any reason, in open position.

By reverse, if no double protection is required, the non-return valve may be a substitute for the actuation valve and a steady actuation element may be provided which interferes with the plug of the cartridge valve and opens it.

The output of the valve assembly is connected to one (or more) of the pipes forming a manifold portion.

The cartridge 85 may be a standard cartridge available on the market, but preferably, as shown in FIG. 11 it is modified to have a concave bottom 93 with a diameter substantially lesser (e.g. 20–40 mm) than the cartidge diameter (which for a standard commercially available cartridge is 86 mm) surrounded by a concave toroidal crown 94.

The bottom may be formed integral to the peripheral wall of the cartridge, as shown in the left side of FIG. 11, or formed as a severed element which is coupled to the peripheral wall by curling, in a well established manner, as shown in the right side of FIG. 11.

By this design it is possible to easily handle the cartridge and to rotate it, so as to screw the boss in the valve assembly recess, even if the cartridge is closely surrounded by the frame wall or located in juxtaposition to other like cartridges.

The cartridges can therefore be arranged in the frame very tightly, without hampering their operability, thus minimizing the size of the frame.

It is clear that, whilst the pressure reducer/regulator preferably constitutes a part of the distributor assembly which has been described, it may alternatively constitute an integral part of the consumer appliance and may be integral with a supply tube of the appliance to which the distributor assembly is connected.

This is for the purpose of ensuring the fullest compatibility of the distributor assembly with existing consumer appliances, supplied by refillable cylinders, in which, in general, the pressure reducer/ regulator is already present, is not removed together with the cylinder and constitutes a fixed component of the consumer appliance.

Likewise, it is clear that the described assembly finds application not only for the supply to domestic gas appliances, but also in equivalent cooking, heating and lighting appliances for leisure time, camping and recreation.

In particular in nautical activities, the need is particularly felt to avoid the on-board installation of heavy and bulky refillable liquefied-gas cylinders, which constitute a non-negligible risk factor, and to replace them with combustible-gas sources which are lighter and less bulky and can be stored as reserves in confined spaces, and can be distributed in a plurality of spaces, including spaces which are remote from the consumer appliance, and can be readily supplied.

To enhance safety in use, storage and transportation of the manifold assembly the embodiment of FIGS. 10,11 may be further provided, owing to the fact that the frame, when closed by the upper and lower cover forms a leaktight box or container, where possible gas leakage may be confined, with devices tailored to different applications.

Figure 12:
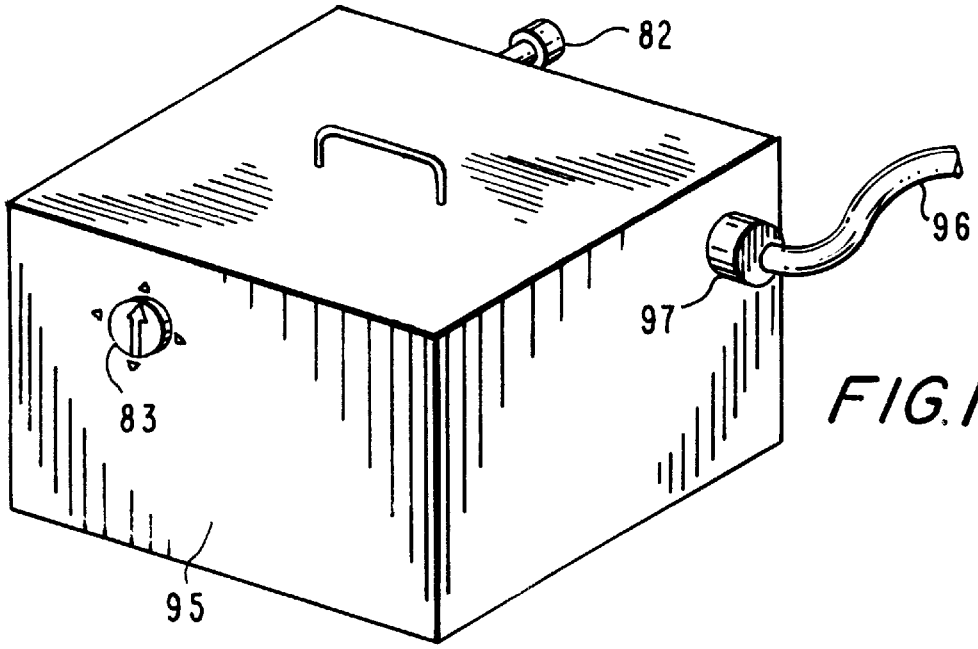
FIG. 12 is a perspective schematic view of the embodiment of FIG. 10, further provided with a vent pipe and/or visual or acoustic devices for signalling possible gas leakage.

For example, as shown in FIG. 12, the leaktight box 95, when used indoor, may be provided with a vent pipe 96 for conveying any possible gas leakage from the equipment to the outside environment.

This is also important for safety in transportation: if the box is stored in the baggage compartment of a car, it is advisable to avoid any possible risk of inflammable mixture formation in the baggage compartment. The vent pipe 96, directed outside the the compartment, through the compartment door resilient gasket (or any suitable opening) fits this purpose.

Clearly the delivery pipe 82 may be closed by a plug.

The knob 83, which is preferably removable from the actuation shaft,. when set in the shut-off position me be removed, to avoid any casual switching of the multiple way tap in an open position.

As a possible alternative a knob lock may be provided.

As a further safety measure the box or container 95 may be provided with acustic signalling devices, such as a buzzer or whistle 97, actuated bu the gas flowing out of the box through the vent pipe 96.

A visual indication may be provided too and may consist in an inflatable element, swollen by the overpressure developed by the gas leakage inside the container, such as for instance a closed end helicoidal tube which takes a straight form, for a predetermined internal overpressure.

What is claimed is:

1. A manifold/distributor assembly for combustible gas supplied from a plurality of liquefied-gas cartridges, comprising a frame forming a plurality of housings, each having an open end for the insertion of one of a plurality of liquefied gas cartridges and an opposite end closed by a neck, a plurality of valve assemblies each incorporating an actuation element, each valve assembly being mounted on the neck of one of said housings with inlet to said valve assemblies from said actuation element and an outlet, a plurality of means, each for bringing about a relative displacement between a cartridge housed in one of said housings and the actuation element of the related valve assembly mounted on the neck of said housing, in the axial direction of said actuation element, said relative displacement establishing a fluid communication between said cartridge and said related valve assembly and opening said valve assembly, conditional on the presence of said cartridge, a manifold connected to the outlet of said plurality of value assemblies and to a delivery pipe, characterized in that the manifold/distributor assembly further comprises manually operated shut-off tap means in said manifold, operable independently on said valve means, for selectively connecting the output of said valve assemblies to said delivery pipe through said manifold, wherein said shut-off tap means comprises a multiple way shut-off tap for selectively controlling the fluid communication among portions of said manifold and said delivery pipe.

2. The manifold/distributor assembly of claim 1, further comprising a pressure regulator (81) interposed between said multiple-way shut-off tap (80) and said delivery pipe (82).

3. The manifold/distributor assembly of claim 1, including a plurality of cartridges (85), wherein said cartridges (85) are valve-type with a screwed boss (87) enclosing a cartridge shut-off valve (88) with a pushable plug (89), and wherein said plurality of means for bringing about said relative displacement each comprises said screwed boss (87) and a screwed recess of said valve assemblies, where said screwed boss may be screwed.

4. The manifold/distributor assembly of claim 3, wherein said actuation element is movable from a first to a second position, owing to interference with a valve plug of a cartridge shut-off valve, said actuation element, when in said first position closing a valve assembly incorporating said actuation element, when in said second position opening said valve assembly and said cartridge shut-off valve.

5. The manifold/distributor assembly of claim 4, wherein said valve assemblies each comprise a differential pressure operated non return valve (92) cascaded to an obturator (90) extending in said actuation element (91).

6. The manifold assembly of claim 1, wherein said frame (1), closed by an upper (65) and lower (64) cover, forms a leaktight box.

7. The manifold/distributor assembly of claim 6, wherein said leaktight box comprises a vent pipe (96).

8. The manifold/distributor assembly of claim 6, wherein said leaktight box comprises gas leakage signalling means (97).

9. The manifold/distributor assembly according to claim 1, 2, 3, 4, 5, 6, 7, or 8, including a plurality of cartridges, wherein each cartridge comprises a cylindrical body with a concave bottom having diameter substantially less than the diameter of said cylindrical body, surrounded by a concave toroidal crown.

10. The manifold/distributor assembly according to claim 9, wherein each cartridge comprises a cylindrical body with a concave bottom having a diameter from about 20 mm to about 40 mm less than the diameter of said cylindrical body.

* * * * *